United States Patent [19]

Martel et al.

[11] Patent Number: 4,990,750

[45] Date of Patent: Feb. 5, 1991

[54] INDEPENDENTLY POWERED SAFETY DEVICE

[75] Inventors: Thomas J. Martel, North Reading; John S. Sklenak, Sudbury, both of Mass.

[73] Assignee: Raytheon Company, Lexington, Mass.

[21] Appl. No.: 438,817

[22] Filed: Nov. 9, 1989

[51] Int. Cl.[5] ..... H05B 3/68

[52] U.S. Cl. ..... 219/453; 219/506

[58] Field of Search ..... 219/453, 506; 340/584, 340/593, 594, 693

[56] References Cited

U.S. PATENT DOCUMENTS

| | | | |
|---|---|---|---|
| 1,136,407 | 4/1915 | Carrigan | 340/594 |
| 1,657,103 | 1/1928 | Berger | 219/506 |
| 2,492,100 | 12/1949 | Kitson | 219/453 |
| 2,659,069 | 11/1953 | Kinsella | 219/453 |
| 2,870,316 | 1/1959 | Ferguson | 219/453 |
| 3,494,321 | 2/1970 | Moore | 219/453 |
| 3,852,728 | 12/1974 | Flagg | 219/453 |
| 4,199,754 | 4/1980 | Johnson | 340/584 |
| 4,388,520 | 6/1983 | McWilliams | 219/464 |
| 4,794,233 | 12/1988 | Goessler | 219/453 |
| 4,812,827 | 3/1989 | Scripps | 340/693 |

FOREIGN PATENT DOCUMENTS

| | | | |
|---|---|---|---|
| 2938257 | 4/1981 | Fed. Rep. of Germany | 219/506 |
| 2951409 | 7/1981 | Fed. Rep. of Germany | 219/453 |
| 1346574 | 2/1974 | United Kingdom | 219/464 |

*Primary Examiner*—Teresa J. Walberg

*Attorney, Agent, or Firm*—William R. Clark; Richard M. Sharkansky

[57] ABSTRACT

An independently powered safety device for use in a cooking device having a heating element and a cooking surface. The safety device includes a pair of lamps, one of which is disposed below the heating element and another which is disposed adjacent the cooking surface. The safety device also includes a temperature probe that is coupled above the heating element. When the cooking device is turned on, the heating element becomes hot and the lamp disposed below the heating element instantly illuminates. The temperature probe senses the heating element's temperature. In response to the heating element reaching a predetermined temperature, the probe enables the lamp adjacent the heating surface to illuminate. That lamp remains illuminated until the cooking device is turned off and the heating element cools. The lamp adjacent the heating surface is independently powered and remains illuminated regardless of whether or not power is provided to the heating element.

7 Claims, 3 Drawing Sheets

INDEPENDENTLY POWERED SAFETY DEVICE

BACKGROUND OF THE INVENTION

The invention relates to displaying that a cooktop surface has reached a predetermined temperature and more particularly to indicating that a stove-top cooking surface remains hot when the cooking unit has been disconnected from a power source.

Heating elements are commonly used in cooktop cooking. Alternating current power is distributed through the coils of the heating element, such as an electrically resistive heating element. The heating element then becomes hot and heats the food on the cooktop.

Many cooktops are constructed with enclosed and insulated heating elements which are disposed in a counter-top assembly below a layer of thermal glass that functions as a utensil supporting surface. Enclosing these elements prevents heat from being dissipated to the surrounding air. Further, the glass heating surface acts as a thermal barrier and retains heat for up to as much as 20 minutes after cooking has been completed. Consequently, the user may not detect that the heating surface is hot. Thus, the user may be burned by accidentally touching the glass heating surface.

Cooktops having glass cooking surfaces have been built with a display next to a control panel. These displays indicate that the cooking surface temperature is hot. However, these indicators are located away from the cooking surface and accordingly, the user may not realize that when he looks directly at the cooking surface that it is hot to the touch.

Another device that has become popular in counter-top cooking is the removable cartridge. The removable cartridge is constructed with an insulated and enclosed heating element disposed below the glass cooking surface. Accordingly, as with any glass cooktop, when the cartridge is removed, the cooking surface retains heat without any indication. Thus, the cooking surface, once removed from the counter-top, may accidentally be touched, thereby inflicting injury upon the user.

SUMMARY OF THE INVENTION

An object of this invention is to provide an improved cooktop assembly for use in counter-top cooking.

Another object of this invention is to provide an indication for the temperature of a cooking surface in a cooking cartridge when the cooking surface is hot and the cartridge is removed from the counter.

It is also an object of this invention to provide an instantaneous indication that the cooking surface is on when power is applied to the heating elements.

An additional object of this invention is to indicate when the cooking surface has cooled to a temperature which is no longer harmful to the touch.

It is also an object of this invention to provide a heat indicator that is powered by a rechargeable power source that recharges from the current provided to the heating element and discharges to a lamp that indicates that the heating element is hot.

These and other objects are accomplished with an apparatus disposed within a cooktop assembly for use on a counter for indicating the temperature of the cooking surface. The apparatus comprises means disposed within the cooktop assembly for heating the assembly cooking surface, and means, in thermal communication with the heating element, for displaying that the temperature of the cooking surface is above a predetermined temperature when the cooktop assembly is removed from said counter to provide an indication to the apparatus user that the cooking surface is hot to the touch. It is preferable that the apparatus further comprise means for selectively applying power to the heating means, and means disposed adjacent the heating means within the assembly for indicating that power is being applied to give an instantaneous indication that the cooking surface is on. It may also be preferable that the apparatus further comprise means for selectively applying and removing power to the heating means, and means providing a signal to the displaying means when the heating means exceeds the predetermined temperature and when power is removed from the heating means to provide an indication that the temperature of the cooking surface is hot even when external power is removed from the assembly.

Alternately, an apparatus for indicating the temperature of a counter-top cooking surface is provided comprising a counter cooktop having an aperture disposed therein. Also provided is a cooking cartridge, disposed within the aperture comprising: an electric resistor heating element for heating the cooking surface, a thermostatic limiter responsive to the surface temperature above the electric resistive heating element exceeding a first predetermined temperature, first means for selectively providing power to the heating element, and an indicator disposed adjacent said heating element. The cooking cartridge further comprises second means coupled to the indicator through the limiter for providing power to the indicator when the limiter responds to the cooking surface temperature exceeding a first predetermined temperature, and the cooking cartridge is removed intact as an assembly the said counter cooktop. By having a second means providing power to the indicator, an indication of the cooking surface temperature is provided even when the heating element is turned off from the removable cooking cartridge and when the cartridge is removed from the counter cooktop.

Also provided is the method of displaying the temperature of a cooking surface on a counter top comprising the steps of heating the assembly surface, sensing the temperature of the heated cooking assembly surface, and indicating the temperature of the cooking assembly surface with an indicator when a predetermined temperature is sensed. The method further comprises the steps of stopping the heating of the cooking assembly surface, removing the cooking assembly from the counter, and providing power to the indicator after the cooking assembly has been removed from the counter to give an indication that the heating surface is still hot after removal. It may be preferable that the method further comprise the steps of removing the cooking assembly surface indicator as an assembly from the counter, and indicating that the cooking assembly surface temperature is too hot to touch without burning the fingers when the assembly is removed from the counter to prevent accidental injury.

Another embodiment of the apparatus is provided for indicating that a heating element is turned on. The apparatus comprises a cooking surface constructed from a luminescent ceramic material, means disposed below the ceramic material for heating the cooking surface, and means disposed below the heating elements for illuminating through the ceramic material the area adjacent the heating means when the heating means heats the cooking surface to provide an instantaneous "on" indication.

DESCRIPTION OF THE PREFERRED EMBODIMENTS

Figure 2:
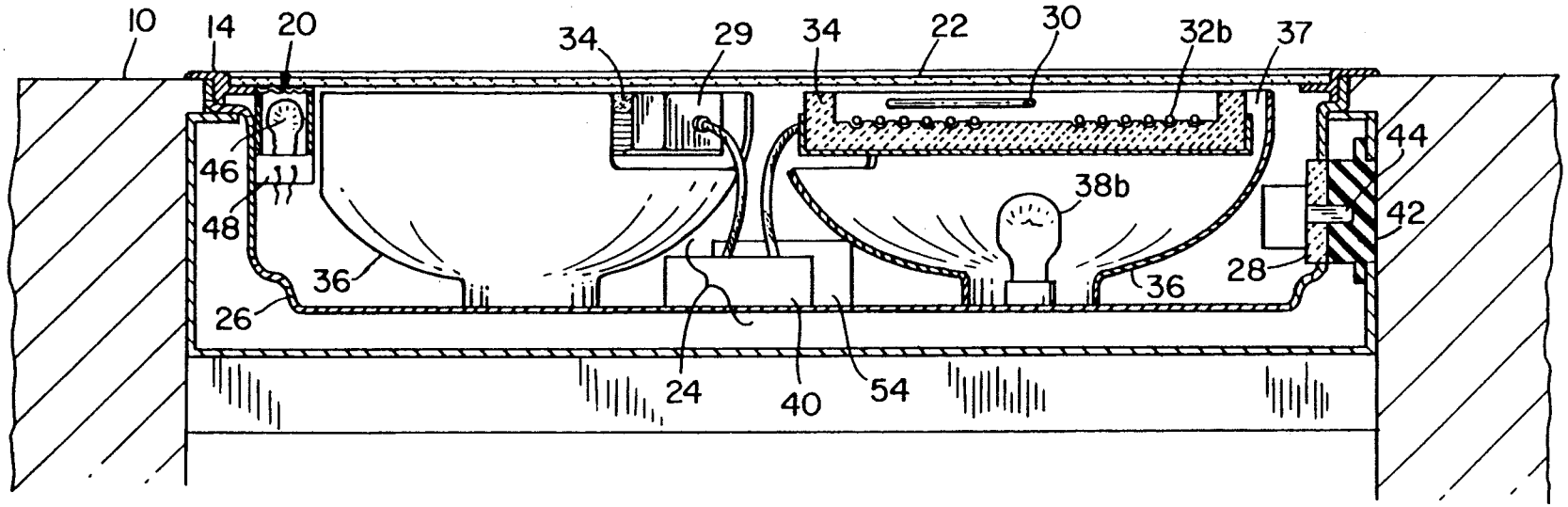
FIG. 2 is a side view of the cooktop assembly embedded in the counter-top shown in FIG. 1 along line 2—2.
Figure 3:
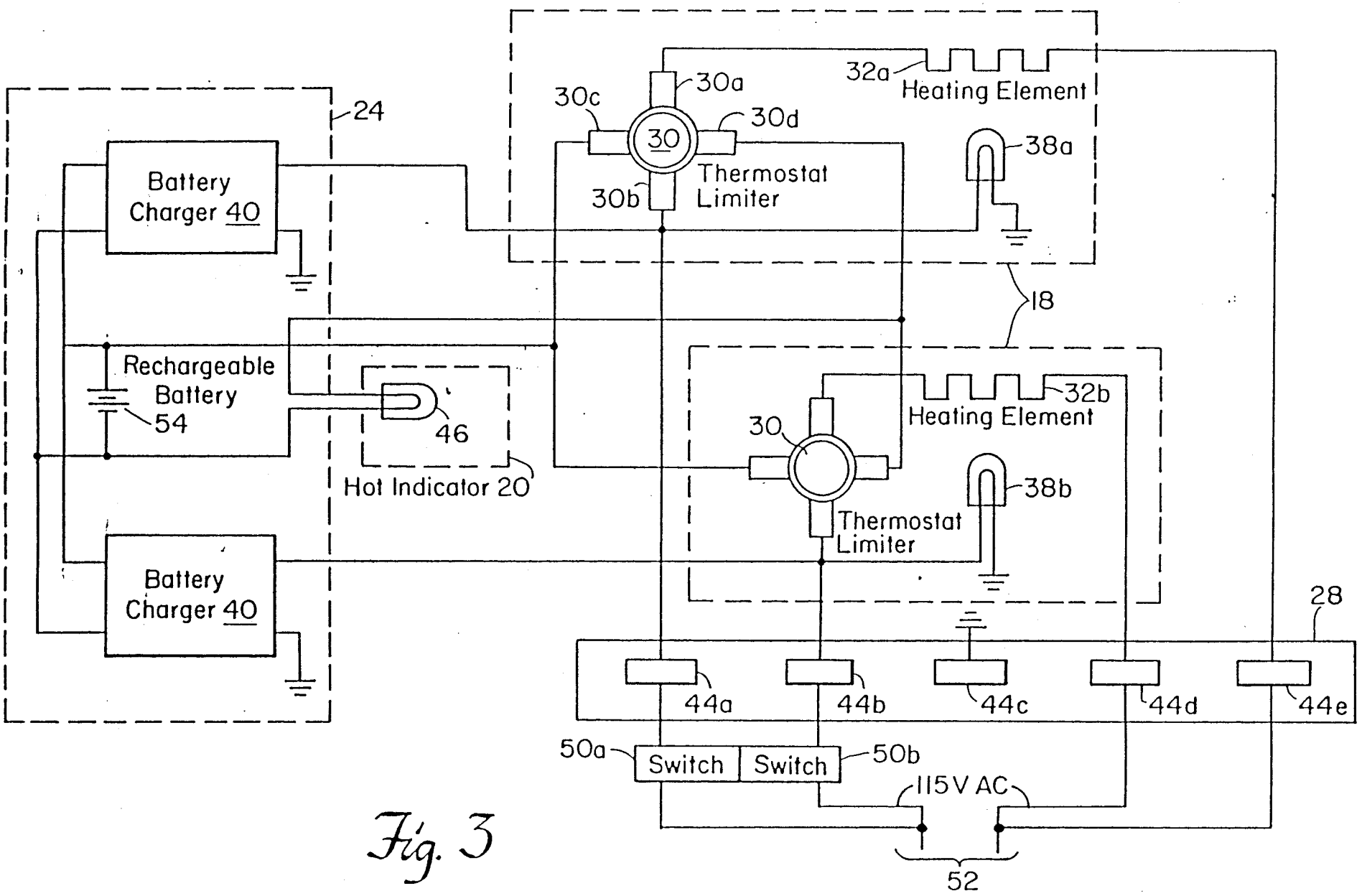
Figure 1:
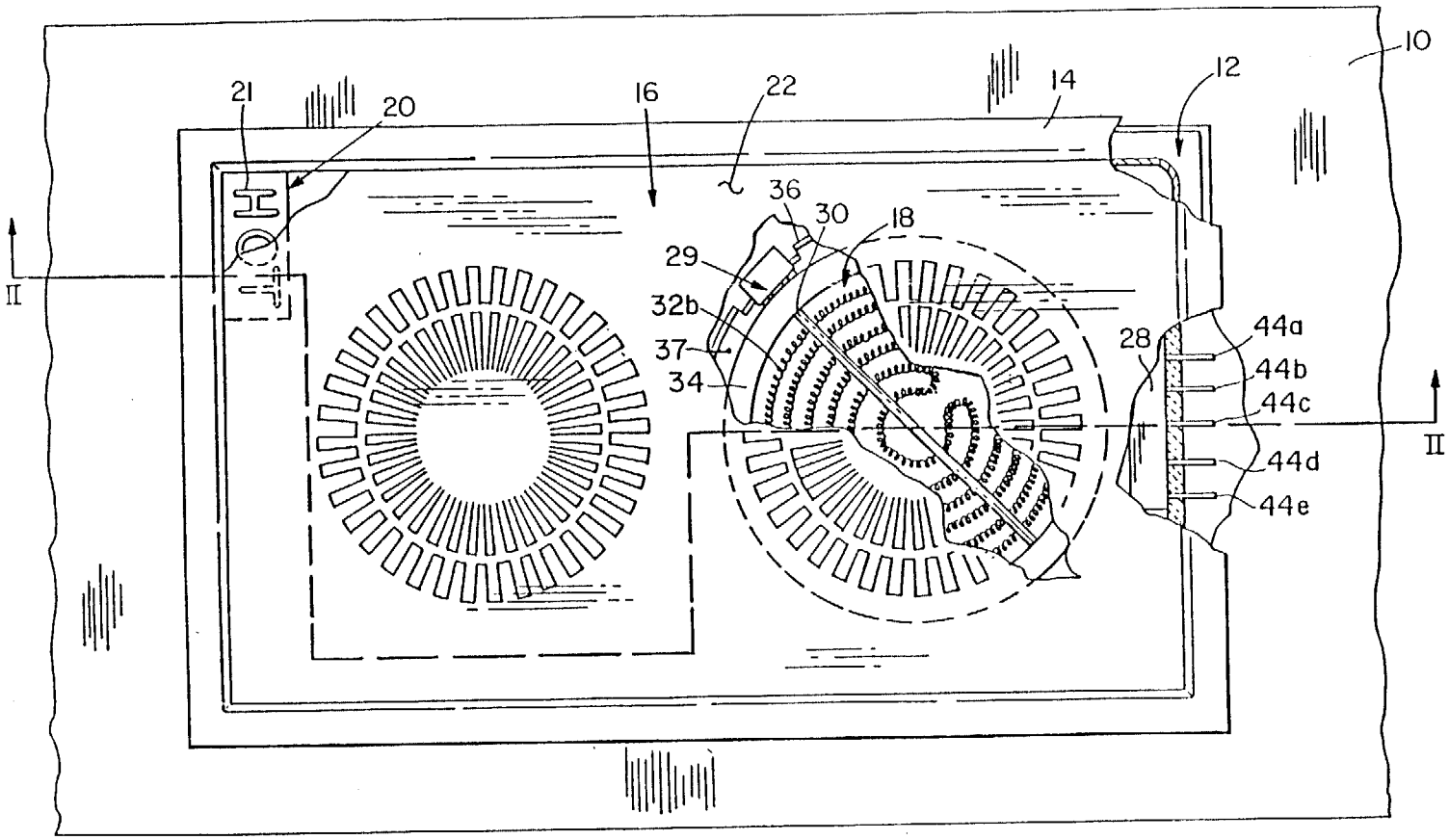
FIG. 1 is a top view of the cooktop assembly in cartridge form embedded within a counter-top.

Referring to FIGS. 1 and 2, there is shown a counter 10 having an aperture 12 disposed therein. Disposed within the counter 10 along the perimeter of aperture 12 is frame 14. Disposed on frame 14 within aperture 12 is cartridge or cooktop assembly 16.

Cooktop assembly 16 includes heating means 18, display means 20 having a "HOT" indicator 21, ceramic glass plate 22, rechargeable power source 24 (FIG. 2) and cartridge frame 26 (FIG. 2).

Disposed on the rear of cartridge frame 26 is connector 28. Heating means 18 is electrically coupled through rechargeable power source 24 to connector 28.

Heating means 18 includes a thermostat means 29, heating elements 32*a* and 32*b*, element insulator 34 and reflector 36. Heating elements 32*a* and 23*b* are preferably an electrically resistive coil. Heating element 32*a* and 32*b* thermally communicates through ceramic plate 22 to heat items disposed on the surface of ceramic plate 22. Insulator 34 surrounds heating element 32*a* or 32*b* to contain its heat so that maximum heat is transferred from heating element 32 through ceramic glass plate 22. Disposed below heating element 32*a* or 32*b* and element insulator 34 is reflector 36. Reflector 36 is preferably parabolic shaped and made from a light reflective material such as aluminum. Reflector 36 has a hole in its center where there is located lamp 38*b* (FIG. 2). When lamp 38*b* is enabled, reflector 36 reflects light from lamp 38*b* upwardly around insulator 34 through gap 37 and illuminates light through ceramic glass plate 22. Thermostat means 29 includes a thermostatic limiter 30 which switches off and on connecting terminal 30*a* to 30*b* and terminals 30*c* to terminals 30*d* (see FIG. 3) when heating element 32*a* or 32*b* heats glass plate 22. One such limiter is model number 19T manufactured by Thermodisk, Inc., of Mansfield, OH. When glass plate 22 reaches a predetermined temperature, thermostatic limiter 30 couples rechargeable power source 24 to hot indicator or display means 20, thereby illuminating hot indicator 20.

Rechargeable power source 24 includes a battery charger such as a 115V AC to 9V DC converter 40 coupled to displaying means 20. Rechargeable power source 24 is connected to the junction of displaying means 20, heating means 18 and connector 28.

Connector 28 has a jack 44 which connects to plug 42 within frame 14. Electric power is supplied to cooktop assembly 16 through connector 28.

Displaying means 20 has "HOT" indicator 21, a lamp 46 and a support means 48 for supporting lamp 46 below the surface of ceramic glass plate 22. "Hot" indicator 21 is coupled to ceramic plate 22 and is formed in the shape of "HOT" so that the letters "HOT" illuminate through ceramic plate 22 when lamp 46 is illuminated.

Figure 3:
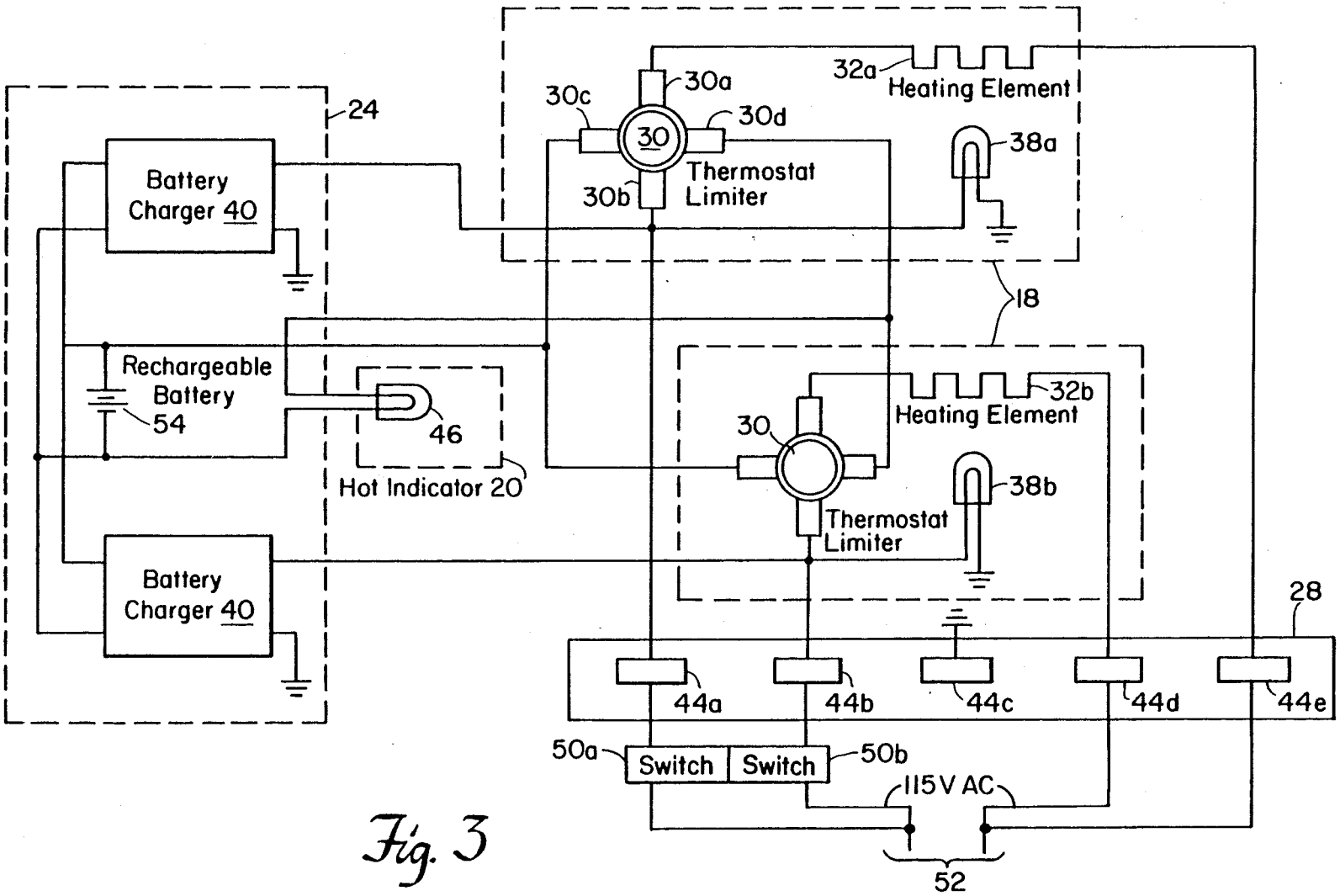
FIG. 3 is a schematic diagram of the electronics for the cooktop assembly and its safety device.

Referring to FIG. 3, there is shown a schematic for the cooktop assembly 16 shown in FIGS. 1 and 2. Cooktop assembly 16 has a connector 28 which is coupled through stove switch 50*a* and 50*b* to 115V alternating current (AC) on line 52. Stove top switch 50 s preferably located on top of or on the side of counter 10 (not shown). Switch 50*a* and 50*b* removes and applies power from line 52 to cooktop assembly 16.

Connector 28 comprises a plurality of jacks 44*a*–44*e*. Jack 44*c* is coupled to ground and cartridge frame 26. Alternating current on line 52 is fed through jacks 44*d* and 44*e* to heating element 32*b* and heating element 32*a*, respectively. Jacks 44*a* and 44*b* are coupled to the junction of battery charger 40 within rechargeable power source 24, lamp 38*a* and lamp 38*b*, respectively, and thermostatic limiter 30. Lamp 38*a* instantaneously illuminates in response to an alternative current (AC) signal being applied across jack 44*a* and jack 44*e*. Lamp 38*b* illuminates in response to an AC signal being applied across jack 44*b* and jack 44*d*.

Heating element 32*a* is energized n response to an AC signal being applied from stove switches 50 across jack 44*a* and jack 44*e*; heating element 32*a* is energized in response to an AC signal being applied across jack 44*b* and jack 44*d*, respectively.

Thermostatic limiter 30 senses the temperature above heating elements 32*a* and 32*b*. Thermostatic limiter 30 includes four terminals 30*a* through 30*d*, of which terminal 30*a* is normally coupled to terminal 30*b*, and terminal 30*c* is normally decoupled from terminal 30*d*. However, thermostatic limiter 30 couples terminal 30*c* to terminal 30*d* when the temperature above heating elements 32*a* or 32*b* exceeds approximately 90° F., and terminal 30*a* decouples from terminal 30*b* when the temperature above heating element 32 exceeds approximately 600° F. The temperature at which terminals 30*c* couples to 30*d* is preferably 90° F.; however, a thermostatic limiter may be selected having higher temperatures at which thermostatic limiter 30 closes the circuit to illuminate hot indicator 20.

Rechargeable power source 24 comprises battery charger 40 and a storage element, such as a rechargeable battery 54. Battery charger 40 converts the 115V AC signal applied to jacks 44*a* and 44*b* to a direct current (DC) signal having low-voltage level, preferably around 9V, and then applies the 9V DC signal to rechargeable battery 54.

Coupled to rechargeable power source 24 and thermostatic limiter 30 is lamp 46. When thermostatic limiter 30 electrically couples terminal 30*c* to terminal 30*d*, current flows through thermostatic limiter 30 illuminating lamp 46.

Operation will be explained for exemplary heating element 32*b* that is controlled by switch 50*b*; however, heating element 32*a* and its controlling switch 50*a* operate identically. During operation, when stove switch 50*b* is switched on, 115V AC from line 52 flows through switch 50*b*, jack 44*a* of connector 28 and thermostatic limiter 30 to heating element 32*b*. Further, 115V alternating current flows through connector 28 and is applied across lamp 38*b*, resulting in lamp 38*b* instantaneously being illuminated. Referring to FIG. 2, when lamp 38*b* illuminates, light is directed upward by reflector 36 through gap 37, and through ceramic plate 22 to indicate that the heating element 32 is on. Referring to FIG. 1, alternating current is also applied to battery charger 40 input within rechargeable power source 24. Battery charger 40 converts the alternating current applied to its input to direct current that is then fed to the terminals of rechargeable battery 54. When the direct current is applied to the terminals of battery 54, it recharges.

When power is applied to heating element 32*b*, the portion of ceramic plate 22 above heating elements 32*b* becomes hot. Thermostatic limiter 30 responds to ceramic plate 22 exceeding a predetermined temperature, preferably between 90° F. and 120° F., by electrically coupling terminal 30*c* to terminal 30*d*. This predetermined temperature preferably corresponds to the maximum temperature which would not result in scorching or burning to the hand if ceramic plate 22 was touched. Direct current is then applied from battery charger 40 across lamp 46 within displaying means 20. Lamp 46 responds to the direct current by illuminating, thereby indicating the cooking surface of ceramic plate 22 is hot.

As heating element 32*b* continues to heat up, ceramic plate 22 eventually reaches a high temperature, between 600° F. and 700° F. Thermostatic limiter 30 then decouples terminal 30*a* from terminal 30*b* to remove power from heating element 32*b*.

After power is removed from the heating elements 32*b*, thermostatic limiter 30, heating element 32*b* and ceramic plate 22 eventually become cool. When the temperature of ceramic plate 22 cools below 600° F., thermostatic limiter 30 couples terminal 30*a* to terminal 30*b* to allow power to be applied to heating element 32*b*. This process of coupling terminals 30*a* to 30*b* and decoupling terminal 30*a* to terminal 30*b* occurs continuously to prevent ceramic plate 22 from cracking due to heating element 32*b* high temperatures.

When stove switch 50 removes power from jack 44*a* of connector 28, and heating element 32*b* and lamp 38*b*. Accordingly, the light from lamp 38*b* around heating element 32 and through ceramic plate 22 is removed to indicate that heating element 32*b* has been turned off. When power is removed from connector 28, no current is applied to either battery charger 40 or rechargeable battery 54. However, thermostatic limiter 30 continues to electrically couple terminal 30*c* to terminal 30*d* while ceramic panel 22 is still hot, i.e., above 90° F. Further, direct current is applied from rechargeable battery 54 through thermostatic limiter 30, to lamp 46, resulting in lamp 46 remaining on even when no power is applied to connector 28. In addition, if cooktop assembly 16 is removed from counter 10, lamp 46 remains on.

Eventually, the cooking surface of ceramic plate 22 above heating elements 32*b* cools. When the cooking surface cools to below 90° F., thermostatic limiter 30 decouples terminal 30*c* from terminal 30*d*, thereby removing the direct current applied across lamp 46. Lamp 46 responds to this direct current removal by turning off. Thus, when ceramic plate 22 cools, displaying means 20 indicates that the cooking surface is cool to the touch.

This concludes the description of the preferred embodiments. A reading of those skilled in the art will bring to mind many modifications and alternatives without departing from the spirit and scope of the invention. Accordingly, it is intended that the invention only be limited by the following claims.

What is claimed is:

1. A removable cooktop assembly, adapted to be removably positioned in a counter top compartment and removably mated with a power source of said compartment, said assembly comprising:

a cooktop surface adapted for supporting a cooking utensil;

means positioned under said cooktop surface for providing heat to said cooking utensil;

means responsive to said cooktop surface being above a predetermined temperature for providing an electrical signal; and means responsive to said electrical signal for providing a visual indication of said cooktop surface being above said predetermined temperature when said cooktop assembly is removed from said compartment and disconnected from said power source.

2. The cooktop assembly as recited in claim 1 wherein said visual indication providing means comprises a lamp disposed adjacent said heat providing means in said assembly.

3. The assembly as recited in claim 1 further comprising means for selectively applying power to said heat providing means.

4. The apparatus as recited in claim 3 wherein said electrical signal providing means comprises a rechargeable battery that charges when power is applied to said heat providing means and discharges when said electrical signal is provided to said displaying means.

5. The method of providing a hot surface warning for a cooktop assembly adapted to be removably positioned in a counter top compartment and removably mated with a power source in said compartment, comprising the steps of:

activating said cooktop assembly positioned in said compartment mated to said power source to heat a utensil supported on said surface;

deactivating said cooking assembly;

removing the cooktop assembly from said compartment and disconnecting said cooktop assembly from said power source;

sensing the temperature of said surface;

providing an electrical signal in response to said sensing if the temperature of said surface is above a predetermined temperature; and providing a hot surface warning in response to said electrical signal notwithstanding said cooktop assembly being disconnected from said power source.

6. The method as recited in claim 5 wherein said warning is provided by a visual indicator powered by a rechargeable power source.

7. The method as recited in claim 6 further comprising the step of charging said rechargeable source.

* * * * *

UNITED STATES PATENT AND TRADEMARK OFFICE

CERTIFICATE OF CORRECTION

PATENT NO. : 4,990,750

DATED : February 5, 1991

INVENTOR(S) : Martel et al

It is certified that error appears in the above-identified patent and that said Letters Patent is hereby corrected as shown below:

Sheet 1 of the drawings, consisting of Fig. 1, should be deleted to be replaced with the sheet of drawing, consisting of Fig. 1, as shwon on the attached page.

Signed and Sealed this

Twenty-eighth Day of July, 1992

*Attest:*

DOUGLAS B. COMER

*Attesting Officer*

*Acting Commissioner of Patents and Trademarks*